US007334910B1

(12) United States Patent
Blackstock

(10) Patent No.: US 7,334,910 B1
(45) **Date of Patent: *Feb. 26, 2008**

(54) DECORATIVE OPTICAL DISPLAY

(76) Inventor: Robert K. Blackstock, 5699 Kanan Rd., #128, Agoura Hills, CA (US) 91301

( * ) Notice: Subject to any disclaimer, the term of this patent is extended or adjusted under 35 U.S.C. 154(b) by 0 days.

This patent is subject to a terminal disclaimer.

(21) Appl. No.: 11/490,752

(22) Filed: Jul. 20, 2006

Related U.S. Application Data

(63) Continuation-in-part of application No. 11/101,970, filed on Apr. 8, 2005.

(51) Int. Cl.
*F21V 33/00* (2006.01)

(52) U.S. Cl. ..... 362/101; 40/406; 40/409

(58) Field of Classification Search ..... 362/101, 362/800; 40/406, 409
See application file for complete search history.

(56) References Cited

U.S. PATENT DOCUMENTS 3,277,240 A * 10/1966 Marjoram et al. ..... 359/493
3,535,805 A * 10/1970 Peiperl ..... 40/406
4,291,307 A * 9/1981 Peelle et al. ..... 345/33
4,742,439 A * 5/1988 Choate ..... 362/311
5,150,257 A * 9/1992 Mohabbatizadeh et al. . 359/601
5,683,174 A * 11/1997 Lena, Jr. ..... 362/318
6,630,968 B1 * 10/2003 Tsuchihashi et al. ..... 349/65
6,681,508 B2 * 1/2004 Unger et al. ..... 40/406
7,019,810 B2 * 3/2006 Hubby, Jr. ..... 349/159
2006/0133064 A1 * 6/2006 Lin ..... 362/101

* cited by examiner

*Primary Examiner*—Sandra O'Shea
*Assistant Examiner*—Mary Zettl
(74) *Attorney, Agent, or Firm*—Koppel, Patrick, Heybl & Dawson; Michael J. Ram

(57) ABSTRACT

A lighted display having a constantly changing image comprises a transparent container holding an aqueous suspension of delaminate vermiculite. A light source is positioned at a first surface of the container so that the light shines through the container and the liquid suspension within the container. First and second polarizer films are placed on opposites of the container with the first polarizer film being located between the light source and the liquid suspension and the second polarizer film being located between the liquid suspension and the observer with the films oriented so that the two axis of orientation are not parallel to each other. Transmitted, polarized light passes through and is modified by the plate-like particles in the suspension and is observed as an image generated by the display. Stirring means are also provided so the aqueous suspension is constantly in motion.

31 Claims, 8 Drawing Sheets
(6 of 8 Drawing Sheet(s) Filed in Color)

DECORATIVE OPTICAL DISPLAY

This is a Continuation-In-Part application of U.S. patent application Ser. No. 11/101,970 filed Apr. 8, 2005.

The invention relates to a decorative display which has an unusual continuously moving iridescent appearance under normal reflected or transmitted light and an even more prominent continuously changing cloud-like, multicolored appearance when viewed with light passing through a pair of polarizers.

BACKGROUND

Rheoscopic fluids have been demonstrated in the past. These fluids generally comprise suspensions of microscopic crystalline platelets in a carrier liquid. They have been used to elucidate flow patterns in mechanical and chemical equipment, such as reactors, chemical processing equipment and heat exchangers to demonstrate laminar and turbulent flow patterns and to identify dead spaces (low flow areas) which can create processing or heat transfer problems during use of such equipment. One example of materials has also been used as a media in artistic display pieces. A common material for these purposes, referred to as Kalliroscopic fluids, is a water based composition which contains a suspension of about 1 to 5% of a non-soluble plate-like polymeric material (P. Matisse and M. Gorman, *Phys. Fluids,* 27, p 759 (1984)

U.S. Pat. No. 5,788,506 refers to the use of another example of such a material, identified as titanium oxide coated mica particles manufactured by Mearlin Corporation under the trade name Mearlin Hi-Lite Gold 9220C. The appearance of these particles, when added to a flowing stream of liquid, changes as light is reflected from particles which have a different orientation when the flowing liquid is observed.

Other examples of materials which can be used to demonstrate flow patterns are aluminum particles, and colloidal suspensions of vanadium pentoxide, milling yellow dye, imogolite [which is a natural hydrated aluminum silicate found in the clays of certain ash from Japanese volcanoes], gibbsite [which comprises hexagonal platelets of $Al(OH)_3$], bentonite [$Na_x(Al_{2-x}Mg_x)(Si_4O_{10})(OH)_2$], LoniteB [$(Na_2Ca)_{x/2}(Li_xMg^{3-x})(Si_4O_{10})$], boehmite (γ-AlOOH) and akaganeite [βFeOOH].

U.S. Pat. Nos. 4,655,842, 4,780,147 and 4,801,403 describe the preparation of stable vermiculite dispersion. These dispersions are then used to prepare a broad range of films and coatings for industrial applications such as non-burning paper, flame barriers, fireproofing coatings on combustible materials, thermal and electrical insulation, and gaskets. Materials covered by the '842 and '147 patent are marketed by Grace Construction Products as MICROLITE Vermiculite Dispersions, a stable vermiculite dispersion in water. Goldberg describes use of such dispersions in the fabrication of water proof coatings for sports equipment (Goldberg, H. A., "Elastomeric Barrier Coatings for Sporting Goods" *Rubber World,* 226, no. 5, p 15-20, 37, August 2002) and shows a jar of a 0.02% MICROLITE viewed through crossed polarizers as an opaque solution with some bright areas to demonstrate the oriented nature of the vermiculite. While at least one of these suspensions has been described as "stable", the stability of these suspensions in an unstirred state is for a matter of minutes or a few hours and not longer periods of time.

SUMMARY

A lighted display which has a continuously changing image which includes a transparent container enclosing a flowing liquid suspension of plate-like particles. The device includes means for imparting motion to the plate-like particles in the container, a light source for providing illumination of the contents of the container, at least some of the light passing through the transparent container, the liquid suspension in the container and one or more light polarizing films positioned in the path of the light passing through the liquid suspension and reaching an observer.

DESCRIPTION OF DRAWINGS

The file of this patent contains at least one drawing executed in color. Copies of this patent with color drawings will be provided by the Patent and Trademark Office upon request and payment of the necessary fees.

DETAILED DESCRIPTION

While there have been prior examples of the use of various plate-like materials to elucidate flow patterns in moving fluids or as art objects these have all been observed with reflected lights because of the generally opaque nature of the suspensions. Transmitted light with crossed polarizers of very low concentration suspensions of vermiculite has been used solely by Goldberg only to demonstrate the plate-like characteristics of a MicroLite® composition used for commercial fabrication of films and coatings. However, the unique artistic display characteristics of vermiculite suspensions presented as a moving fluid in a closed transparent vessel and viewed by transmitted light through cross polarizers has not been shown or suggested in prior publications.

Figure 1:
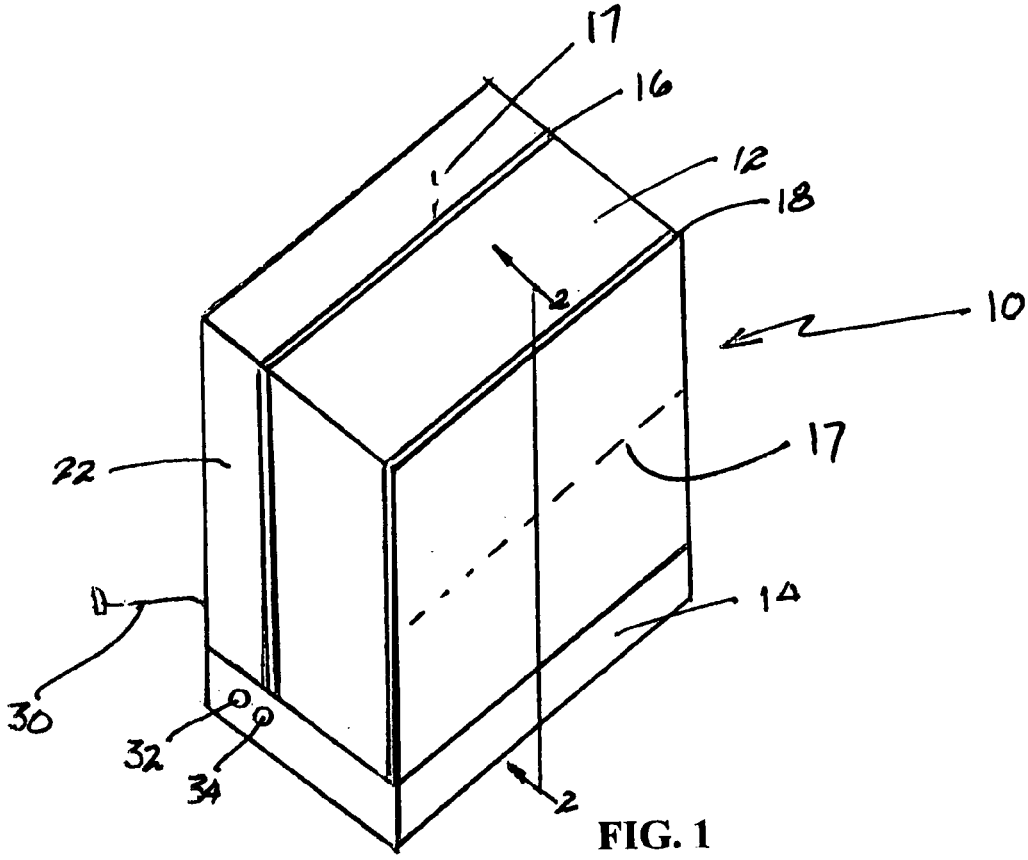
FIG. 1 is a schematic, elevated perspective view of a display device incorporating features of the invention.
Figure 2:
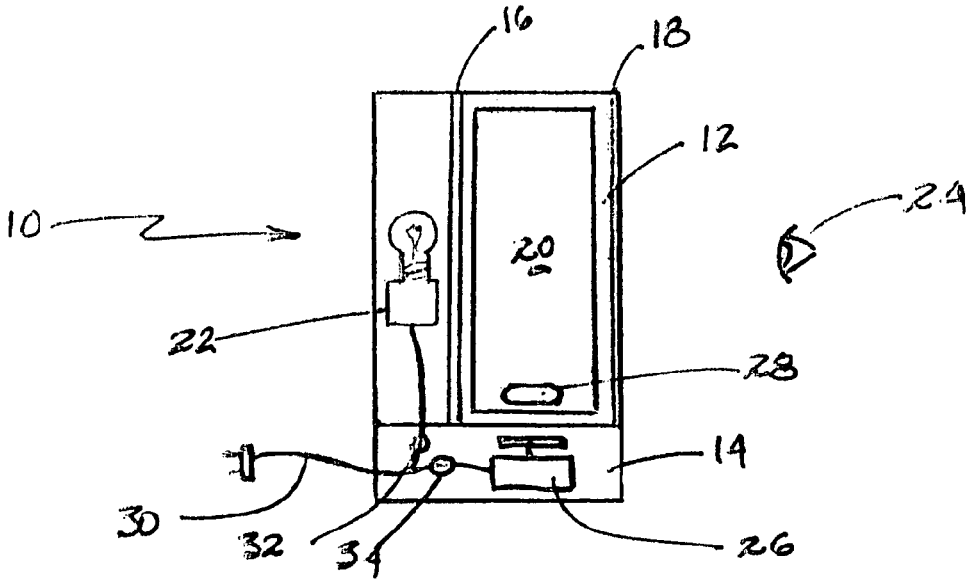
FIG. 2 is cutaway view taken along line 2-2 of FIG. 1.

Referring to FIGS. 1 and 2 an optical display device 10 incorporating features of the invention includes a transparent container 12, in this instance located on a stirring device 14, positioned between first and second polarizer films 16, 18, each film having an axis of orientation 17. This basic component is similar to an instrument, referred to as a Polariscope, which is basically a tool for determining strain patterns developed during fabrication and manufacturing of products, viewing optical characteristic of gems, or elucidating the certain characteristics of liquid crystal films. It permits determination of strains in most transparent materials and is valuable in production or as a laboratory tool wherever glass is fabricated, welded or bent. As polarized light travels through strained glass or plastic positioned between the polarizers the light undergoes a retardation proportional to the amount of stress. A Polariscope is an instrument which can be used to qualitatively view this retardation In the embodiment shown in FIGS. 1-2 the first polarizer film 16 is a linear polarizer with its axis of orientation 17 at 90° to the axis of orientation 17 of a second linear polarizer film, this arrangement generally referred to as crossed polarizers. The container is filled with a suspension of particles in a liquid 20, described below. A source of light 22 is placed behind the container 12 with one of the polarizer films between the light source 22 and the container. The light from the light source 22 is then transmitted through the container 12 and polarizers 16, 18, so that the container 12 and its contents can be observed by an individual 24 positioned beyond the second polarizer 18. Alternatively, one or more circular or elliptical polarizers can be used with a particularly preferred arrangement being a first polarizer which is a linear polarizer and the second polarizer, closer to the observer, being a circular or elliptical polarizer. However, the reverse arrangement of polarizers or various different combinations of polarizer films can be used.

The amount and coloration of the light reaching the observer can be varied by changing the orientation of the axis of the polarizers in regard to each other (varying between 0° and 90°). The individual viewing the transmitted light sees black and white contrasts (isoclines or isoclinic fringes) in the fluid in the containers as well as various colors (isochromes, isochromats or isochromatic fringes) caused by light refracted by the moving particles suspended in the solution in the containers. When circular polarizers are used isoclines are eliminated and only isochromes are observed. Also, due to the nature of the particles used, pleochroism (different colors when viewed from different angles) may also be observed. While it is preferred when using crossed polarizers, that the polarizer films be at 90° to each other to obtain a preferred result, different angles can be used. The intended effect can be observed when the axis of orientation are not parallel, preferably at angles of at least 20°, and the unique appearance of the operating device with the polarizer films at an angle of orientation of the axis of the films less than 90°, i.e. less then perpendicular, for example 80° to 100° is not significant. However, even when the axis are parallel the isoclines are still apparent but the isochromes are significantly diminished. While flat films have been shown, curved films and circular polarizers can be used in the same manner in place of the flat-linear polarizers. Also, the device can be assembled so that the angle of orientation between the films can be varied, as well as the contour of the film surface, during operation. In addition, while it is preferred that the films be parallel, it is not necessary and they can be positioned at an angle to each other. Still further, at least one of the polarizer films can be mounted for rotary motion so that the angle between the axes of orientation can be varied manually or continuously by mechanical means during operation. Still further, a wire grid polarizer can be used and the polarization electrically varied or turned on and off.

The suspension of particles in a liquid 20 is preferably comprised of particles of vermiculite having a thickness of from about 5 to about 100 Angstroms, preferably about 10 to 50 Angstroms, and a much greater length and/or width such that the particles have an aspect ratio of greater than about 10,000 to 1, for example as high as 300,000 to 1 or higher, but preferably an average aspect ratio of about 15,000 to 1 to about 20,000 to 1, suspended in an aqueous liquid. A suitable example of vermiculite is Microlite® available as an 80 to 95% water suspension from WR Grace, catalog numbers 903, 923, 963 and 963++. The preferred material is Microlite 963++advertised to be approximately 7.5% delaminated vermiculite dispersed in an aqueous carrier. While various liquid media can be used, in a preferred embodiment about 0.1 to 10 cc, preferably about 0.5 to about 7.5 cc of said 7.5% composition is added to about 200 cc of deionized water or distilled water, the water preferably having a resistivity of greater than about 2 kilo ohms-cm. Other liquids can be used in place of water, but it appears that polar liquids are preferred. Use of methanol or water/methanol solutions can provide more brilliant colors. Glycol/water and sugar/water solutions can also be used. The resultant suspension, based on the supplier's specifications, comprises from about 0.00375% to about 0.375% solids. However, concentrations of from about 0.0025% to about 1.0% can be used. The liquid suspension can also include other materials to modify the image such as metal structures including but not limited to metal particles or steel balls, for example, chrome plated 1/16 inch diameter steel balls, which can be manipulated by electric or magnetic fields in a static or dynamic manner, either temporally or spatially. In addition, the liquid suspension can also include one or more colorants, additional fluids, such as oils, melted wax, or air, vapor or other gas bubbles, including fluids of a different density, which can be present in a continuous or discontinuous phase or suspended particles such as silica or plastic beads which provide shearing action to the moving fluid. To prevent flocculation of the dispersion it is preferred that the conductivity of the composition be kept low (below about 200μ Siemens depending on the ions present) and ions (i.e., $Na^+$, $Ca^{++}$, $Al^{+++}$, etc.) be excluded. Anti agglomeration agents (dispersants) can also be added to stabilize the dispersion.

Figure 11:
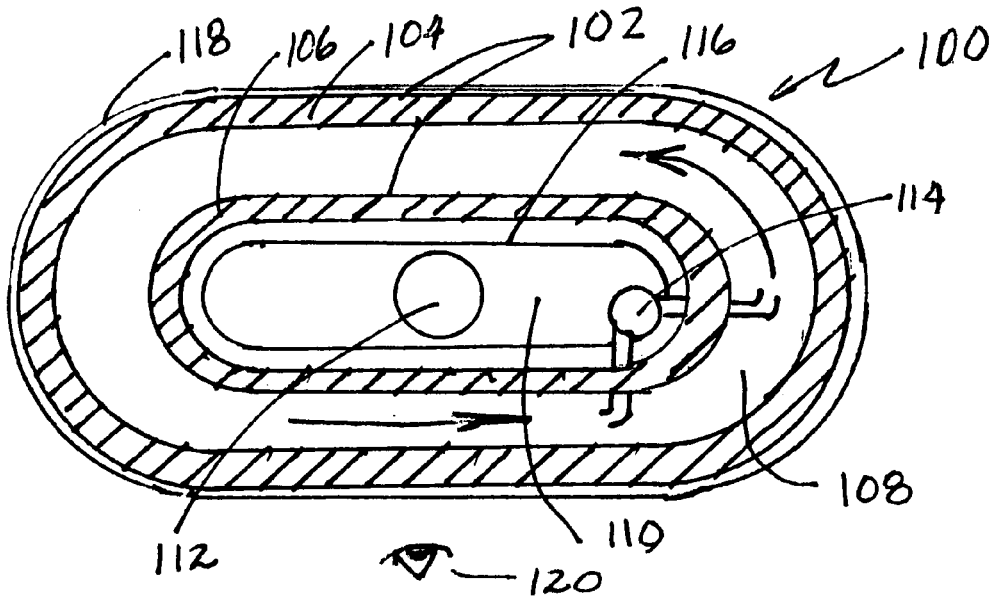
FIG. 11 is a top view of a second display device incorporating features of the invention.
Figure 12:
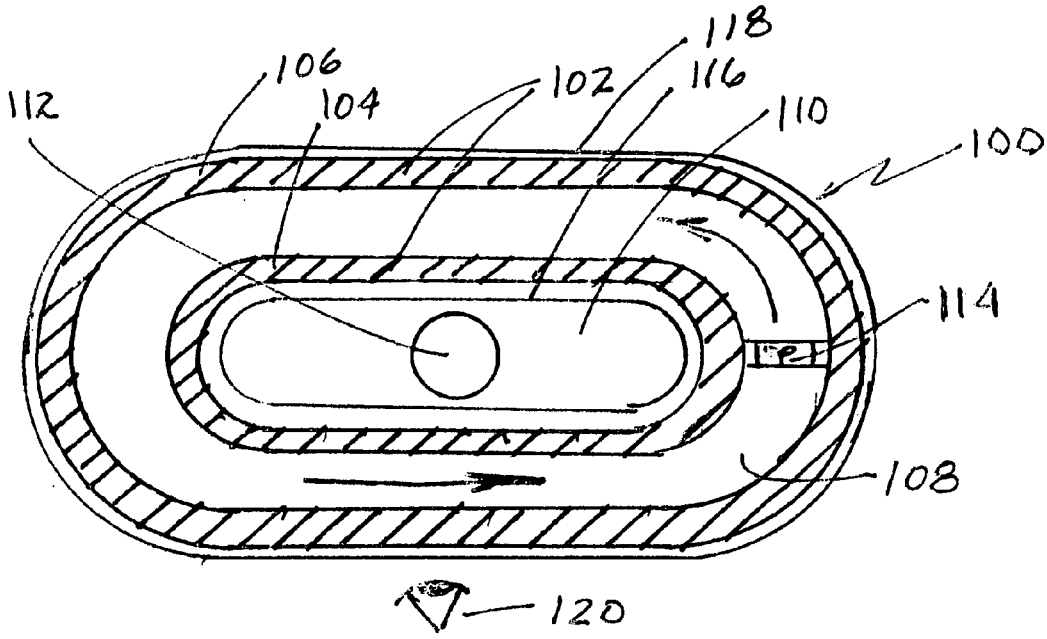
FIG. 12 is a top view of a variation of the device of FIG. 11.

A preferred stirring device 14 as shown in FIGS. 1 and 2 comprises a magnetic stirrer base 26 which operates in conjunction with a stirrer bar 28 located within the container 12. However, other means of providing movement within the container may also be used. For example, a mechanical stirrer with an impeller within the container connected to a motor in the stirrer base 14 by a shaft through a wall of the container can be used or a circulating pump such as used in a fish tank can be incorporated in or connected to the container. FIGS. 11 and 12 show examples of such an arrangement. In addition fixed or moveable barriers, hydrofoils or other flow modifying features can be placed inside the container to create different flow patterns Movement could also be provided by a heater in the base or against a side wall of the vessel which causes convective currents within the container. As a still further alternative the motion can be imparted to the plate-like particles in the container by a moving or vibrating wire or rod in the vessel. The frequency of vibration can be as low as 0.01 Hz or a high frequency in the megasonic range. Another alternative means of providing motion are one or more rotating circular disks, which may rotate in the same or opposite directions or rotate intermittently to create movement. These disks may be positioned horizontally, vertically, or at any angle within the fluid space. It is not necessary that the motion be provided by mechanisms in the container or acting directly on the liquid suspension. Motion can also be applied external to the container such as by manually shaking the container or mounting the container in a device creating a rocking, rotating or vibrating motion such as devices available for creating a wave action in containers holding immiscible liquid (i.e., oil and water). Also the motion need not be continuous and may be intermittent, periodic or random, including periods where no motion is imparted to the device.

While the container 12 shown in FIGS. 1 and 2 is a hollow cube resting on a flat surface, the shape of the container is irrelevant to operation of the device. For example, FIGS. 5-9 show the solution in a jug-handled flask. The device shown in FIGS. 1 and 2, can be referred to as a planar polariscope. One skilled in the art will recognize that, based on the teachings herein, many different configurations and arrangement of components could be used to contain the aqueous suspension. For example, the display device could be constructed to have a vessel within a vessel with the light source in the inner vessel and the first polarizer film located between the light source and the liquid suspension. As a further embodiment, the light source could have the first polarizer film coated on its outer surface and the coated light source could be located in the center of container within the liquid suspension. The second polarizer could then be a coating on the inner or outer wall of the vessel. The light source could also be a source of heat to create convective currents in the liquid suspension. Other configurations include concentric cylindrical tubes with the light source in the center of the tubes. The distance the light travels through the liquid suspension in the container or vessel does not appear to be critical. However, as the distance is increased the intensity of the light source may have to be increased or the concentration of the suspension decreased. A transmission length of about 2 to about 5 cm appears to be preferred but greater or smaller distances can be used, the distance limited only by the transparency of the suspension and the ability to create the desired flow turbulence.

FIGS. 11 and 12 are alternative configurations of a display device incorporating the features of applicant's invention. These display devices, referred to as "race track" displays 100 include a transparent vessel 102 comprising elliptical inner and outer walls 104, 106 defining a fluid space 108. The inner and outer walls are connected by a bottom wall (not shown) and at top wall (which may be removable for filling (also not shown). The inner wall 104 surrounds an enclosed space 110 with a light source 112 located in that enclosed space. While a single light source 112 is shown, multiple light sources 112, or an elongated light source, such as a fluorescent lamp may also be used.

In the device of FIG. 11, a pump 114 removes some fluid from the fluid space 108 and injects that same fluid into the fluid space 108 at a point downstream causing flow of fluid around the race track shaped fluid space 108 in the direction of the arrow in FIG. 11. The device of FIG. 12 uses an impeller 114 located in the fluid space 108 to perform the same function.

As in FIGS. 1 and 2, a first polarizer film 116 is positioned between the light source 112 and the fluid space 108 and a second polarizer film 118 is positioned between the fluid space 108 and an observer 120 located at a suitable observing distance from the display 100. While the polarizer films 116, 118 are shown spaced from the inner and outer walls 104, 106 of the container, they can be adhered to or mounted directly on the inner or outer surfaces of the walls 104, 106 of the transparent vessel 102.

While FIGS. 11 and 12 have been illustrated with the device 100 sitting on its bottom wall so that flow can be observed through a side wall, it is also intended that the device 100 can rest on a side wall with the polarizers positioned for the liquid observed through two polarizers, so that an observer sees the contents of full elliptical path in motion through, for example, the top wall, which one would see if they were looking downward on the device of FIG. 11 or 12 rather then from the side as illustrated.

One skilled in the art will recognize that numerous different devices can be used to create flow in the race track device 100 of FIG. 11 or 12 as well as in the embodiment of FIGS. 1 and 2. Also one skilled in the art will recognize that many different shapes and vessel sizes can be used to contain the fluids described herein and the structures shown and the methods of creating flow are merely representative of display devices which can be selected to exhibit applicant's invention.

Likewise, a broad range of lighting sources 22 may be used. While the preferred source is an incandescent bulb greater than about 5 watts, the more preferred source is a 20 to about 60 watt bulb. However a broad range of light sources may be used including but not limited to fluorescent or halogen bulbs, LEDs, high intensity discharge lamps, mercury vapor, or sodium vapor lamps. In addition, colored lighting, light filters and multiple lighting sources as well as varying color and intensity light sources can be used to further vary the appearance of the optical display and some can be polarized while others are not. Light can also be provided by ambient sources such as the sun or light sources in the surrounding area. In addition, the light can shine directly through the container or may be reflected off one or more mirrors.

FIGS. 1 and 2 show the light source 22 and the stirrer 26 connected to a electric cord 30 so that standard 110 volt power can be provided to the light source 22 and stirrer mechanism 14 components of the optical display 10. However, power can be provided by other sources such as disposable or rechargeable batteries, solar cells, etc. The device can also include an on/off switch to control the power. FIGS. 1 and 2 include two switches 32, 34 so that the intensity of the light source and the speed of the stirrer or, in the case of a heat source used to create convective currents, temperature of the source can be individually controlled. It is also possible that the illumination source, such as an incandescent bulb could provide both the transmitted light and heat to generate the convective currents in the suspension within the container. Also the switches do not have to be just on/off switches but may be used in conjunction with means to constantly vary the light intensity, color and mixing speed, for example varying from vigorous movement to stagnant or causing a pulsatile movement.

FIGS. 3-10 are images of a prior composition and compositions prepared as described herein using applicant's formulations and configuration. While the examples were stored and observed at room temperature (25° C.±5° C.), similar images were obtained at temperatures as high as 50°-70° C. and as low as about 10° C. (higher and lower temperatures were not tested). The only difference appears to be smaller colored domains at higher temperatures and larger colored domains at lower temperatures.

Figure 3A:
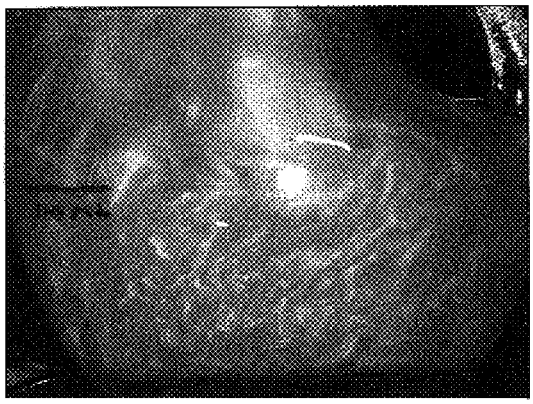
FIGS. 3*a*, 3*b* and 3*c* are front views of a representative container of a liquid suspension of a prior available material used in art displays, illuminated from the front.
Figure 3B:
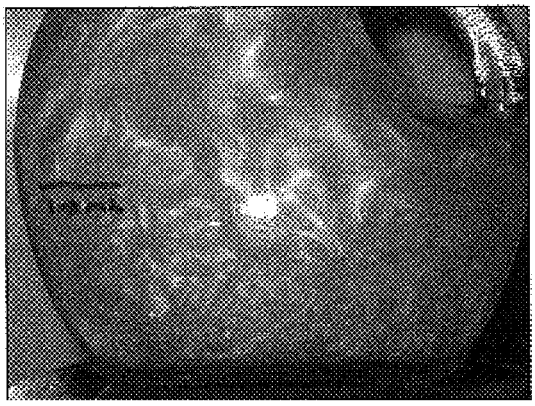
Figure 3C:
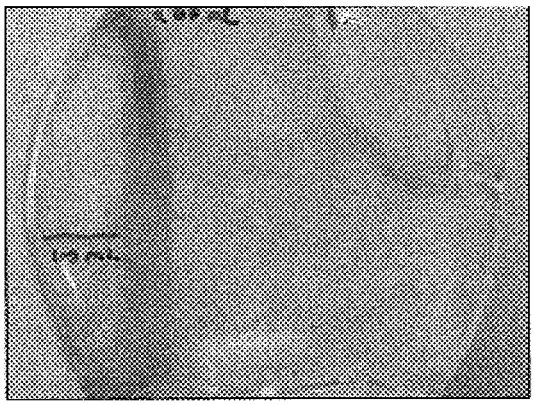
Figure 4A:
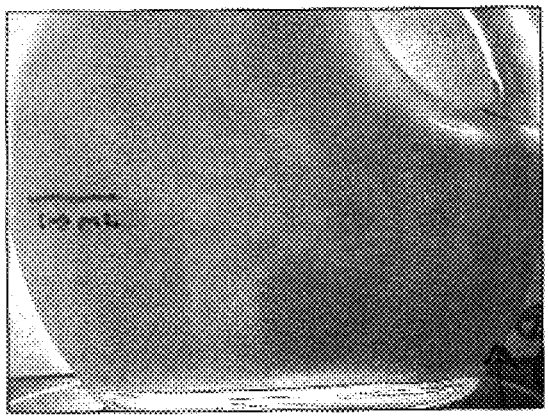
FIGS. 4*a*, 4*b* and 4*c* are front views of the liquid suspension of FIGS. 3*a*, 3*b* and 3*c* illuminated from the rear and viewed through crossed polarizers.
Figure 4B:
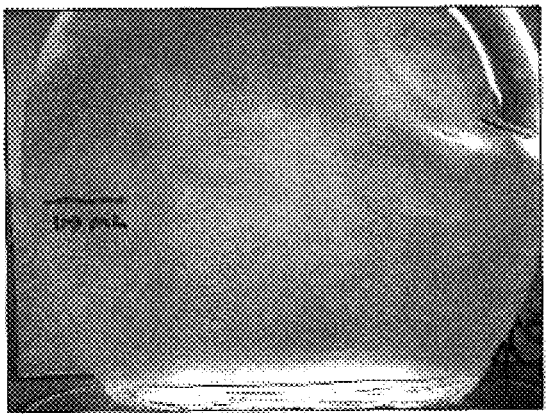
Figure 4C:
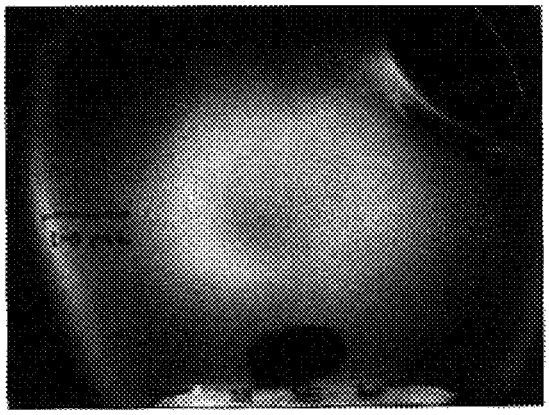

FIGS. 3*a*, 3*b* and 3*c* are photographs of a suspension using the Matisse Kalliroscopic composition, a prior available material used to exhibit flow patterns, as received (concentration unknown), diluted to 50% and diluted to about 3% by adding distilled water in a jug-handled flask with front lighting from a flash bulb. All of the suspensions were opaque with high optical reflectance. FIGS. 4*a*, 4*b* and 4*c* are photographs of the same suspension with back lighting observed through crossed polarizers. Due to the opaque nature of the solution, virtually none of the back-lighting passes through the solution to the observer. This material failed to provide any of the optical characteristics demonstrated by the solutions of the present invention, namely, no streaming birefringence or pleochroism. Further dilution to 0.75% or lower increased the transparency of the composition but did not result in any of the optical characteristics shown by applicant's invention.

Figure 5A:
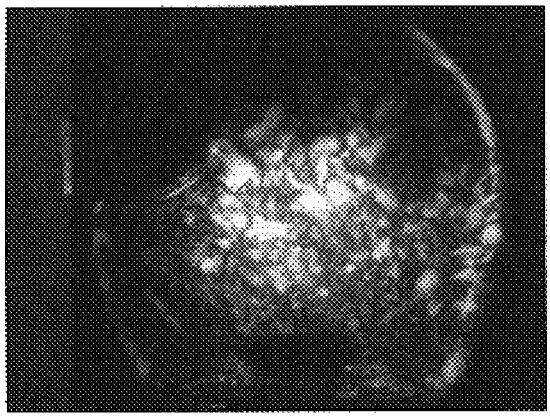
FIGS. 5*a*, 5*b* and 5*c* are front views of a representative container of a liquid suspension incorporating features of the invention illuminated from the rear and viewed through crossed polarizers.
Figure 5B:
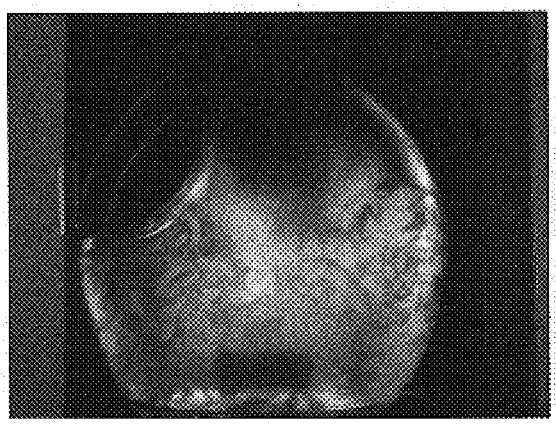
Figure 5C:
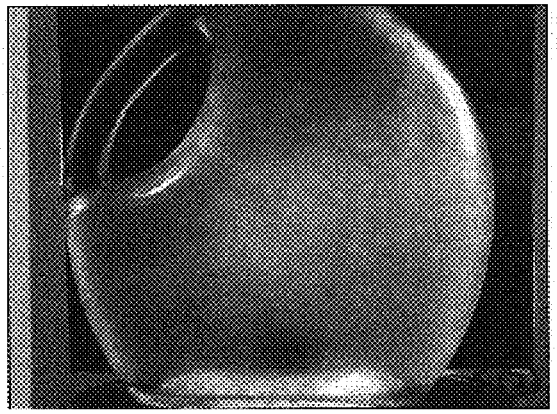

For comparison, FIGS. 5*a*, 5*b* and 5*c* are photographs of a container holding a vermiculite suspension incorporating features of the invention with back lighting and crossed polarizers. These photographs were generated using Microlite 963++ indicated by the manufacture to be a 7.5% dispersion of "clean" vermiculite. (In comparison with the other Microlite materials, 963++ was processed by the supplier to remove undesirable contaminants and forms of vermiculite). Drying tests by applicant on the 7.5% suspension indicated it actually contained about 9.35% solids. FIG. 5*a* is 0.75 ml of Microlite 963++ added to 200 ml of distilled water (approximately 0.03% solids). FIG. 5*b* is 3.6 ml of Microlite 963++ added to 200 ml of distilled water (approximately 0.15% solids). FIG. 5*c* is 10 ml in 200 cc of distilled water. The distilled water had a very low ion concentration, as demonstrated by a conductivity of 15μ Siemens. The suspensions were maintained in constant movement by use of a magnetic stirrer bar in the container within the stirrer motor set at a medium speed. While these photographs were taken the day the suspensions were prepared, similar compositions remain stable, without significant flocculation or degradation of the optical characteristics for extended periods of time (>3 months). The stirring bar 28 is clearly visible in the lower portion of the container.

Figure 6A:
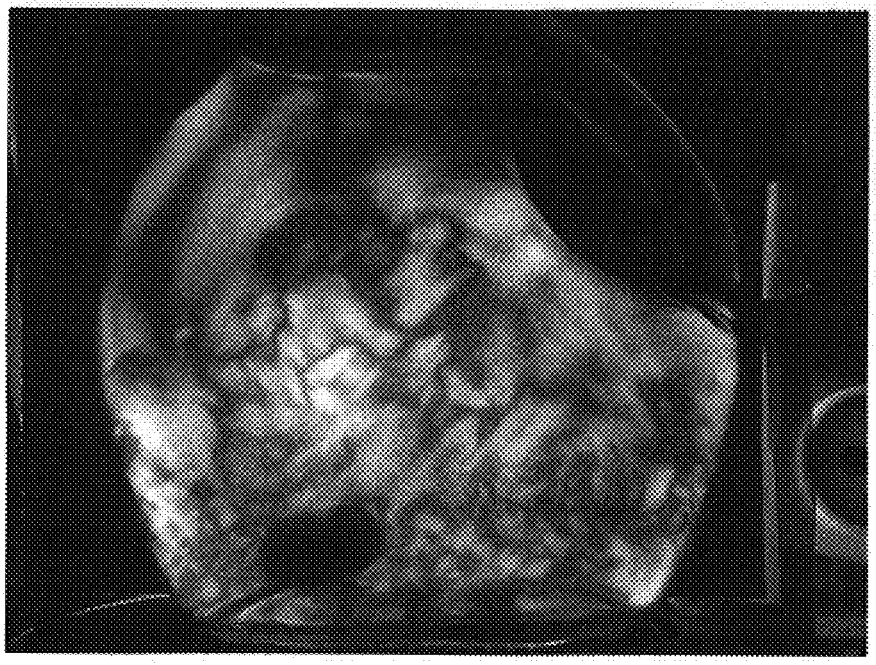
FIGS. 6*a* and 6*b* are front views of the liquid suspension with cross polarizers and with the front polarizer partly removed to demonstrate the appearance of the suspension without the crossed polarizers.
Figure 6B:
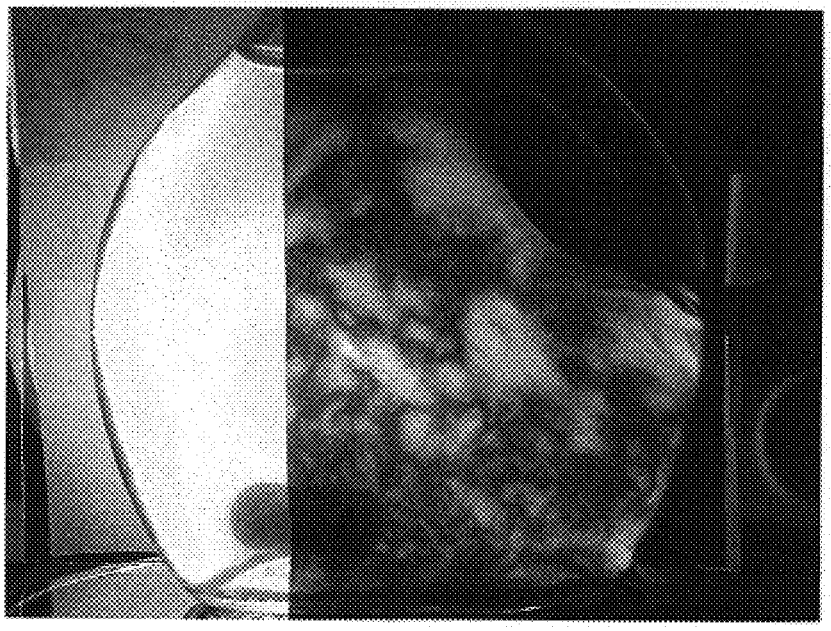

FIG. 6*a* is a similar solution with cross polarizers; FIG. 6*b* has the front polarizer pulled to the right to show the appearance of the container contents with back lighting in the absence of crossed polarizers. FIGS. 5*a*, 5*b* and 5*c* and 6 demonstrate the unique appearance of applicant's suspensions when viewed under polarized light. The photographs illustrate the appearance at a single moment in time. Because the fluid in the container is constantly in motion the observed appearance is constantly changing with the dark and light regions in constant movement, like moving clouds or smoke with a constantly changing appearance and a variety of changing colors as the transmitted light is refracted through the moving particles within the suspension, demonstrating both streaming birefringence, pleochroism and, with circular polarizers, isochromism.

Figure 7:
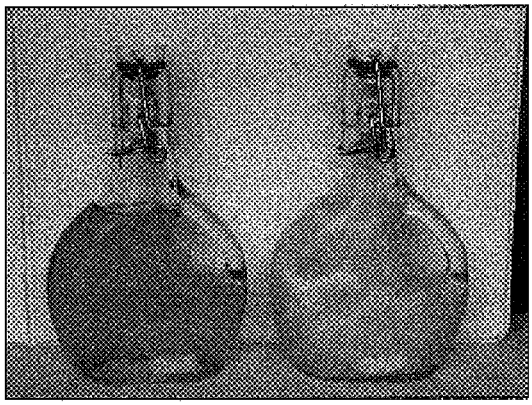
FIGS. 7-9 are several front views of containers of a representative liquid suspension incorporating features of the invention compared to a prior available composition used in art displays, both illuminated from the front, over a period of time.
Figure 8:
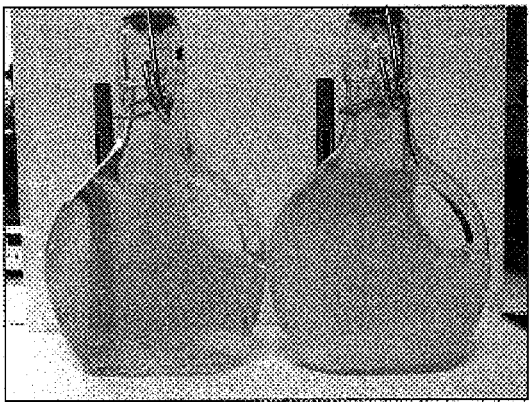
Figure 9:
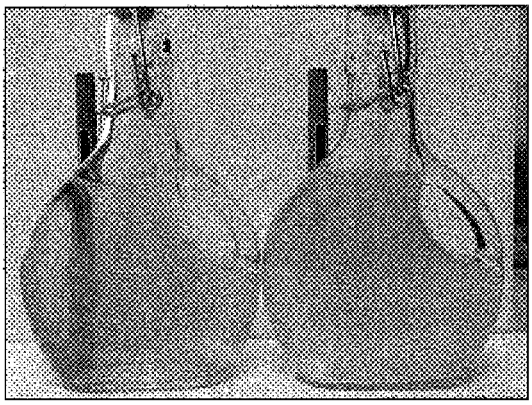

A further unique aspect of the applicant's composition is the stability of the suspension when compared to prior available compositions, such as the Matisse (Kalliroscope) compositions which have been used to produce artistic displays. FIGS. 7-9 compare the stability and clarity of applicant's suspension with that of a suspension made with the Matisse material, both at their preferred concentrations, placed in the same jug-handled flask. Each figure shows the Matisse suspension on the right and an example of applicant's suspension on the left, both lighted from the front. To demonstrate the difference in transparency to light of the two compositions a rod is placed between the flask and the background screen in FIGS. 7 and 8. FIG. 7 shows each suspension as prepared. In FIG. 8 each suspension is shown after standing for 12 hours; FIG. 9 is after standing for 24 hours. As is shown in FIG. 8, the Matisse solution is opaque, the rod not being visible through the suspension. However, the upper ¼ portion is clearer as a result of the suspension settling. In addition, some of the suspended Matisse material has settled on the bottom of the flask and is visible next to the stirrer bar. In contrast, in applicant's suspension the rod behind the flask is visible at all times through out the height of the filled container, evidencing the transparency of the suspension to transmitted light. By 24 hours significant settling of the Matisse suspension has occurred and additional material has settled out and is visible on the bottom of the flask. The stability and transparency to transmitted light of applicant's suspension is substantially unchanged over the 24 hour test period.

While the invention has been described in regard to a specific embodiments demonstrating the unique features of applicant's composition for use in artistic optical displays, one skilled in the art based on the teachings herein will recognize that numerous devices can be constructed within the scope of the claims utilizing polarizers at different angles to each other and transmitted light. The optical display described herein is not limited to artistic displays but may also be included as part of utilitarian devices such as clock or watch faces, surfaces on furniture such as table tops or kitchen appliances or incorporated in windows or wall structures. It is contemplated that various different lighting sources, including colored lights and multiple lights, different means to maintain the suspension in constant movement and different shape and sized containers can be used. In addition, dyes or other coloring means may be added to the suspension to further modify the appearance of the display. Also various filters can also be placed in the optical/light path to modify or enhance the colors, for example using ¼, ½, etc. wave plates to selectively eliminate or enhance certain colors (i.e., eliminate reds to enhance greens and blues). The display can be arranged in any orientation, for example with light provided from the side or top, or with the stirrer mechanism behind or above the display. Also as indicated the polarizer films can be various different locations within or on the container as long as the light passes through a polarizer on either side of the liquid suspension. Still further, while transmitted light directly observed by the viewer is described, other means of displaying the effect are contemplated. For example, the light source may be between the observer and the liquid suspension with the image created projected on an object spaced from the device such as a wall, screen, or a separate moving object. Still further mirrors can be used to reflect the light or the image and prisms or lenses can be provided to further modify the image.

The preferred material is a delaminated vermiculite, preferably suspended in distilled or deionized water. Typical city tap water is not preferred as it may contain ions which promote flocculation and as a result, over a period of time, the particles may agglomerate or settle out, degrading the originally obtained optical appearance of the assembled device and suspensions. However, stabilizers may be added to retard flocculation. In addition, a pH of about 3 to about 11, preferably a neutral solution (a pH of about 6.0-8.0) is preferred as a more stable solution is produced.

It has also been observed that Microlite 963++ may contain a very small amount of larger particles or possibly vermiculite particles not fully delaminated. Therefore, a further improvement comprises the use of a refined Microlite 963++ obtained by forming the suspension in distilled water, allowing the undesirable components to settle out and decanting off the "refined" suspension. A procedure for preparing the refined 963++ is as follows:

EXAMPLE 1

Figure 10A:
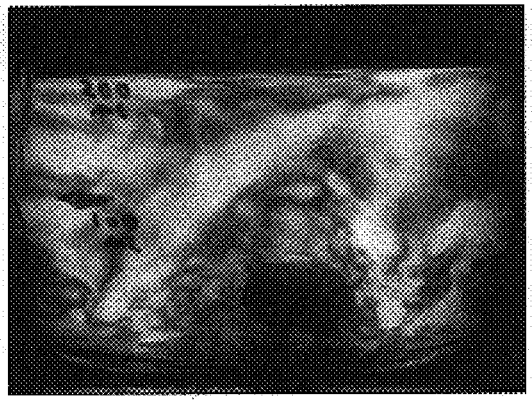
FIGS. 10*a*, 10*b* and 10*c* are photographs of a refined vermiculite suspension observed through cross polarizers over a period of time.
Figure 10B:
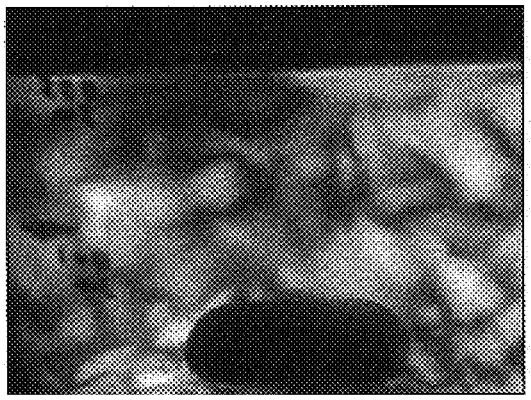
Figure 10C:
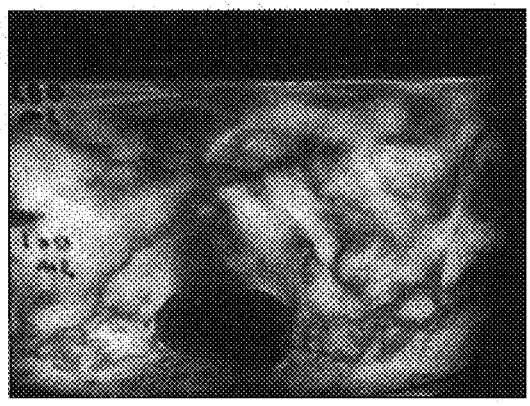

10 ml of as-received Microlite 963++ was mixed with 600 ml of distilled water with stirring for about 10 minutes to assure the formation of a uniform dispersion. The dispersion was then allowed to sit at room temperature for 12-24 hours. The upper 80-90% of the dispersion was then separated from the balance and that portion was used to prepare a display device as described herein. The resultant suspension appeared to have improved stability, reduced flocculation and at least the same if not better desired optical characteristics (streaming birefringence and pleochioism) as shown by FIGS. 10*a* (as prepared), 10*b* (1 week) and 10*c* (day 22).

The unique aspects of the invention may also be achieved using other phylosilicates or other materials which are very thin and have a high aspect ratio i.e., materials comprising long flat molecules or assembly of molecules, which align when placed in a flowing liquid stream, commonly referred to as streaming birefringent materials.

Therefore the scope of the invention is limited only by the claims set forth herein. While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A lighted display having a changing image comprising:

a transparent container holding a stable suspension of plate-like particles in a liquid, the plate-like particles comprising delaminated sheets of vermiculite, means for imparting motion to the plate-like particles in the container, a light source positioned at a first surface of the container to deliver light to the first surface of the container, a second surface of the container and the liquid suspension within the container, the light being transmitted through the first surface, the liquid suspension and the second surface of the container, and a first and second polarizer film, the first polarizer film being located between the light source and the liquid suspension and the second polarizer film being located between the liquid suspension and the observer, said polarizer films being linear or circular polarizers, such that transmitted, polarized light passing through and modified by the plate-like particles in the suspension can be observed as an image generated by the display.

2. The lighted display of claim 1 wherein the first and second polarizer films are linear polarizer films and the axis of orientation of the first linear polarizer film is substantially perpendicular to the axis of orientation of the second linear polarizer film.

3. The lighted display of claim 1 wherein the first and second polarizer films are linear polarizer films and the axis of orientation of the first linear polarizer film is from about 80° to about 100° to the axis of orientation of the second linear polarizer film.

4. The lighted display of claim 1 wherein one of the first polarizer and second polarizer is a linear polarizer and the other of the first polarizer and second polarizer is a circular or elliptical polarizer.

5. The lighted display of claim 1 wherein the light source comprises one or more of an incandescent bulb, fluorescent bulb, light emitting diode, cold cathode fluorescent lamp, high intensity discharge lamp, or halogen bulb or ambient light, the light from said light source or sources delivered directly or indirectly.

6. The lighted display of claim 1 wherein the stable suspension of plate-like particles also includes metal structures which can be manipulated by electric or magnetic fields, in a static or dynamic manner, either temporally and spatially.

7. The lighted display of claim 1 wherein the stable suspension of plate-like particles also includes one or more additional fluids, colorants, or particulate matter in a continuous or discontinuous phase.

8. The lighted display of claim 7 wherein the additional fluids are selected from the group comprising oils, melted wax, air, vapor, bubbles of other gases and fluids of a density different from water.

9. The lighted display of claim 1 wherein the means for imparting motion to the plate-like particles in the container comprises a magnetic stirrer located outside the container driving a magnetic stirring bar located in the stable suspension in the container.

10. The lighted display of claim 1 wherein the means for imparting motion to the plate-like particles in the container comprises heating or cooling a surface or heating and cooling surfaces of the container to generate convective currents in the liquid in the container.

11. The lighted display of claim 1 wherein the means for imparting motion to the plate-like particles in the container comprises a pump.

12. The lighted display of claim 1 wherein the means for imparting motion to the plate-like particles in the container is one or more of a moving or vibrating wire, rod, plate, diaphragm or rotating disk acting directly on the liquid suspension of the plate-like particles or manually or mechanically shaking the container holding the liquid suspension.

13. The lighted display of claim 1 wherein the plate-like particles are suspended in an aqueous medium comprising distilled or deionized water or water with a reduced ion concentration or containing stabilizers to reduce flocculation.

14. The lighted display of claim 13 wherein the aqueous medium has a resistivity of greater than about 2 kilo ohms-cm.

15. The lighted display of claim 1 wherein the means for imparting motion provides continuous motion, intermittent motion, periodic motion or random motion.

16. A lighted display having a changing image comprising:

a transparent container holding a stable suspension of plate-like particles in a liquid, said plate-like particles comprising delaminated sheets of vermiculite having a thickness of from about 2 Angstroms to about 100 Angstroms and an aspect ratio of greater than about 10,000 to 1 suspended in an aqueous medium in concentrations from about 0.0025% to about 1.0% by weight, means for imparting motion to the plate-like particles in the container, a light source positioned at a first surface of the container to deliver light to the first surface of the container, a second surface of the container and the liquid suspension within the container, the light being transmitted through the first surface, the liquid suspension and the second surface of the container, and a first and second polarizer film, the first polarizer film being located between the light source and the liquid suspension and the second polarizer film being located between the liquid suspension and the observer, said polarizer films being linear or circular polarizers, such that transmitted, polarized light passing through and modified by the plate-like particles in the suspension can be observed as an image generated by the display.

17. The lighted display of claim 16 wherein the stable suspension of plate-like particles comprises delaminated sheets of vermiculite having a thickness greater than about 10 Angstroms and an average aspect ratio of about 20,000 to 1.

18. The lighted display of claim 16 wherein the first and second polarizer films are linear polarizer films and the axis of orientation of the first linear polarizer film is substantially perpendicular to the axis of orientation of the second linear polarizer film.

19. The lighted display of claim 16 wherein the first and second polarizer films are linear polarizer films and the axis of orientation of the first linear polarizer film is from about 80° to about 100° to the axis of orientation of the second linear polarizer film.

20. The lighted display of claim 16 wherein one of the first polarizer and second polarizer is a linear polarizer and the other of the first polarizer and second polarizer is a circular or elliptical polarizer.

21. The lighted display of claim 16 wherein the light source comprises one or more of an incandescent bulb, fluorescent bulb, light emitting diode, cold cathode fluorescent lamp, high intensity discharge lamp, or halogen bulb or ambient light, the light from said light source or sources delivered directly or indirectly.

22. The lighted display of claim 16 wherein the stable suspension of plate-like particles also includes metal structures which can be manipulated by electric or magnetic fields, in a static or dynamic manner, either temporally and spatially.

23. The lighted display of claim 16 wherein the stable suspension of plate-like particles also includes one or more additional fluids, colorants, or particulate matter in a continuous or discontinuous phase.

24. The lighted display of claim 23 wherein the additional fluids are selected from the group comprising oils, melted wax, air, vapor, bubbles of other gases and fluids of a density different from water.

25. The lighted display of claim 16 wherein the means for imparting motion to the plate-like particles in the container comprises a magnetic stirrer located outside the container driving a magnetic stirring bar located in the liquid suspension in the container.

26. The lighted display of claim 16 wherein the means for imparting motion to the plate-like particles in the container comprises heating or cooling a surface or heating and cooling surfaces of the container to generate convective currents in the liquid in the container.

27. The lighted display of claim 16 wherein the means for imparting motion to the plate-like particles in the container comprises a pump.

28. The lighted display of claim 16 wherein the means for imparting motion to the plate-like particles in the container is one or more of a moving or vibrating wire, rod, plate, diaphragm or rotating disk acting directly on the liquid suspension of the plate-like particles or manually or mechanically shaking the container holding the stable suspension.

29. The lighted display of claim 16 wherein the plate-like particles are suspended in an aqueous medium comprising distilled or deionized water or water with a reduced ion concentration or containing stabilizers to reduce flocculation.

30. The lighted display of claim 29 wherein the aqueous medium has a resistivity of greater than about 2 kilo ohms-cm.

31. The lighted display of claim 16 wherein the means for imparting motion provides continuous motion, intermittent motion, periodic motion or random motion.

* * * * *